United States Patent [19]

Ash, Sr.

[11] 4,277,042

[45] Jul. 7, 1981

[54] BAR SOAP RECEPTACLE

[76] Inventor: Arthur A. Ash, Sr., 34 La Rose Cir. SW., Marietta, Ga. 30060

[21] Appl. No.: 140,474

[22] Filed: Apr. 15, 1980

[51] Int. Cl.[3] ..... A47F 5/00

[52] U.S. Cl. ..... 248/309 R; 248/205 A

[58] Field of Search ..... 248/309 R, 176, 205 R, 248/205 A, 346; D6/89; 211/13

[56] References Cited

U.S. PATENT DOCUMENTS

| | | | |
|---|---|---|---|
| D. 115,433 | 6/1939 | Taddeo | D6/89 |
| D. 151,126 | 9/1948 | Hilenski | D6/89 |
| D. 154,903 | 8/1949 | Caldwell | D6/89 |
| D. 203,331 | 12/1965 | Lanczi | D6/89 |
| 659,803 | 10/1900 | Weller | D6/89 |
| 2,367,161 | 1/1945 | Wild | 248/309 R X |
| 2,494,305 | 1/1950 | Merry | 248/309 R |
| 3,476,257 | 11/1969 | O'Connell | 248/205 A X |
| 3,910,661 | 10/1975 | Geary | D6/89 X |
| 4,092,008 | 5/1978 | Fetter | 248/205 A |

*Primary Examiner*—J. Franklin Foss

[57] ABSTRACT

A receptacle in the shape of a steeply-inclined chute formed of a slick material and having a pair of rungs supported by ribs which extend generally upward from below the lower front edge of the chute to substantially its upper edge. The rungs are in contact with the lower surface of a bar of soap deposited in the receptacle, and the ribs support the bar out of contact with the inclined bottom wall of the chute. No surface of a rectangular bar of soap, when placed in the receptacle, is disposed in a generally horizontal position, thus facilitating the drainage of water away from the soap. Further, the contact between the receptacle and the least sloping surface of the bar of soap, that is, the contact between it and the rung, is minimized by having the plane of the upper surface of each rung generally forming an acute angle with the inclined bottom wall of the chute.

In use, the lower front edge of the chute is disposed below the edge of the ledge of a sink basin to which the base of the receptacle is affixed by adhesive. The proximity of the chute to the sink basin allows a user to transfer a bar of soap to and from the receptacle without dripping water or suds on the ledge. The chute may be attached to the base by means of projections on the underside of the chute which are slidably mounted upon the walls of the base so that the chute can be removed for rinsing without disturbing the base.

11 Claims, 12 Drawing Figures

Fig. 1
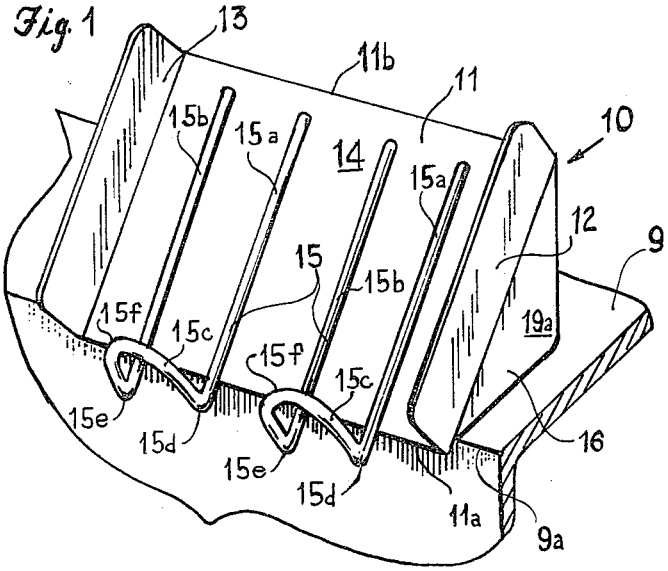
Fig. 2
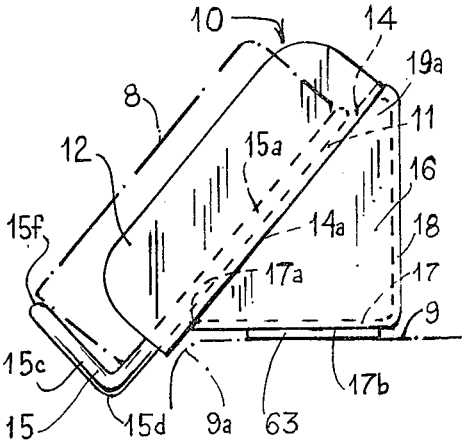
Fig. 3
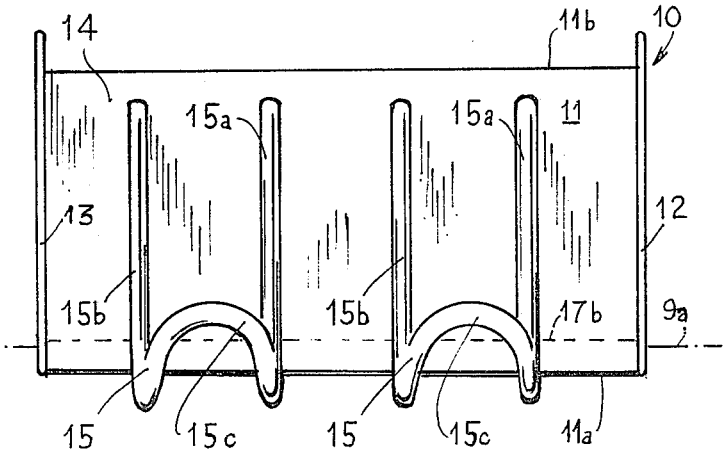
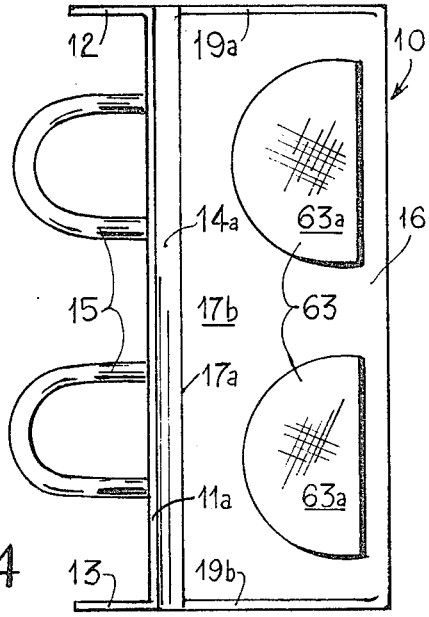
Fig. 4
Fig. 5
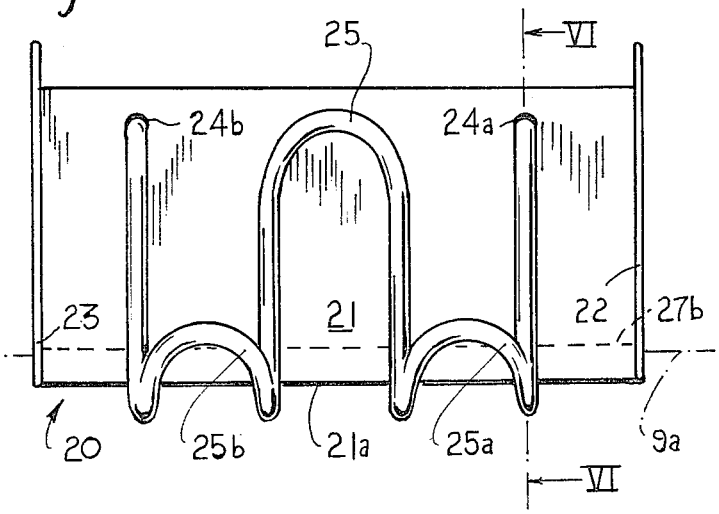
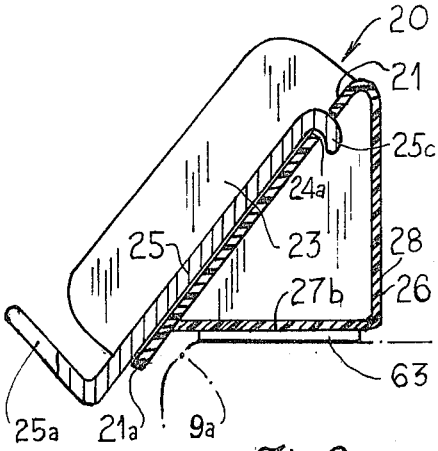
Fig. 6

Fig. 7
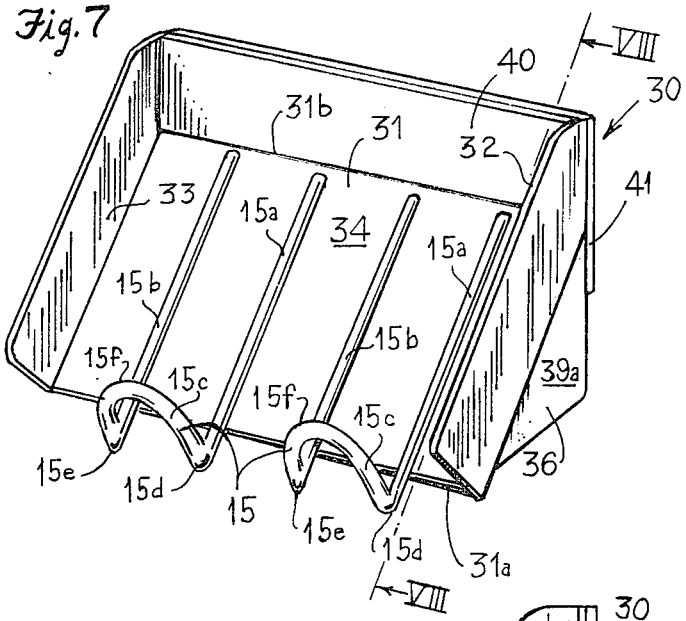
Fig. 8
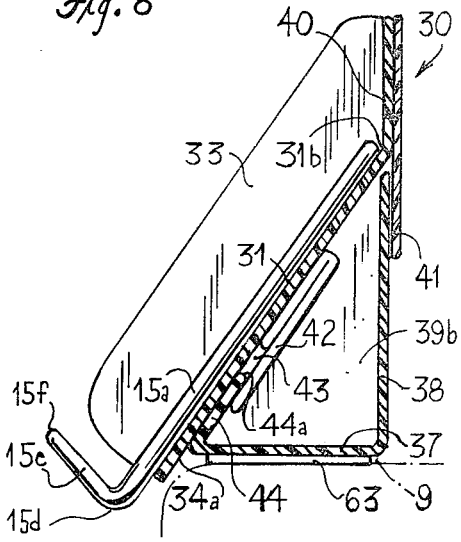
Fig. 9
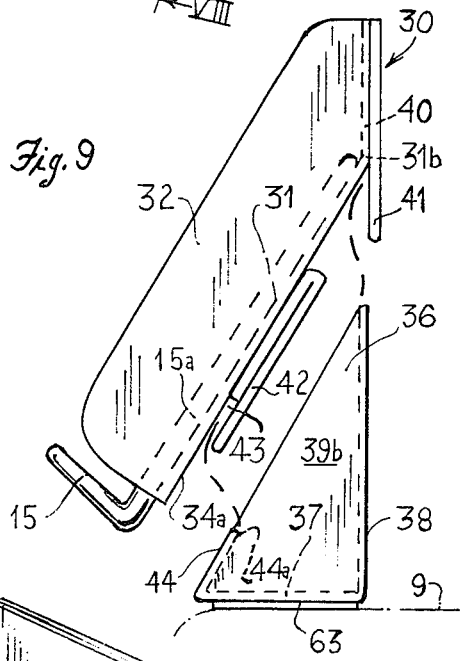
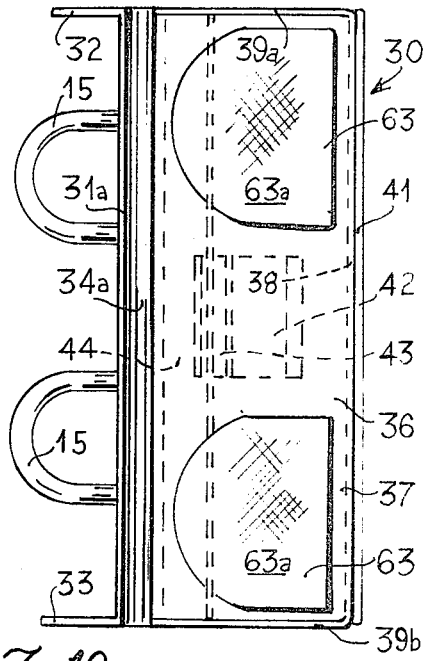
Fig. 10
Fig. 11
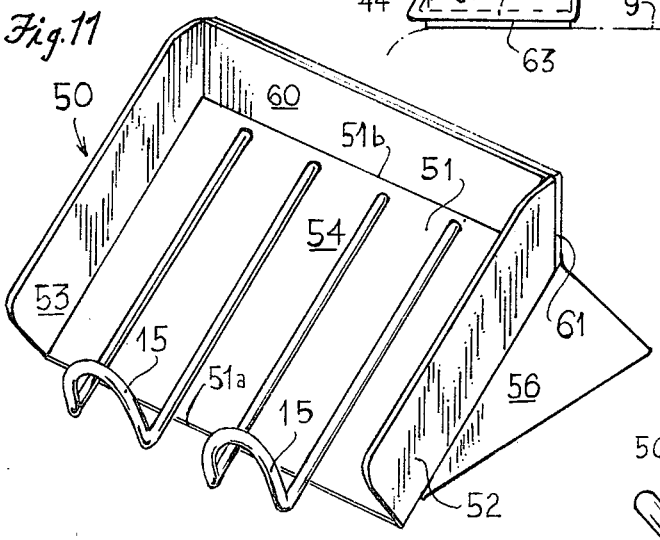
Fig. 12
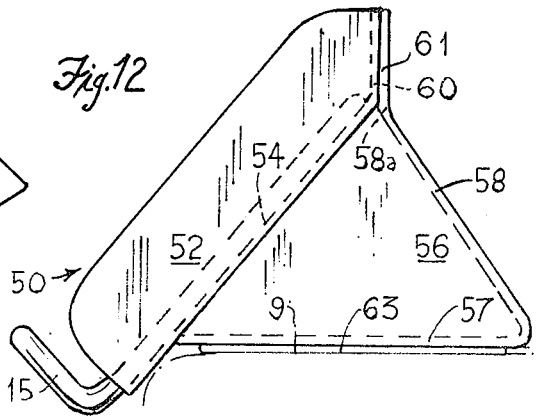

BAR SOAP RECEPTACLE

BACKGROUND OF THE INVENTION

1. Field of the Invention

This invention relates to a bar soap holder or receptacle having an inclined trough to promote water runoff.

2. Description of the Prior Art

Bar soap holders having a wide trough which is inclined downwardly and forwardly have already been described in U.S. Pat. No. 3,910,661.

In the bar soap holder according to the named patent, there is provided a V-shaped trough with an upstanding soap retaining means. The soap retaining means is disposed entirely upwardly of the lower front edge of the trough. In use, a bar of soap is in contact with both the trough and the soap retaining means. A bar may be placed in a generally vertical position to facilitate drainage of water from its larger surfaces; but because the soap retaining means then contacts only the lower portion of the bar, it has a tendency to slide towards a more stable horizontal position. The legs of the bar soap holder rest on the ledge of a sink basin; and the front edge of the trough is positioned in substantial alignment with the edge of the ledge.

SUMMARY OF THE INVENTION

In the subject invention, the inclined trough is in the form of a chute, the lower front edge of which is adapted to extend over the edge of a ledge and downwardly into a sink basin. The soap retaining means is adapted to hold a bar of soap in a generally vertical position out of contact with the bottom wall of the chute. Moreover, the soap retaining means is partially disposed downwardly of the lower front edge of the chute, thus providing a path for water and suds to flow rapidly away from the bar of soap and to concentrate any residual soap solution which would otherwise accumulate along the lower edge of the chute on a projection below the chute, so that the solution will drip into the basin before evaporating to form a soap scum.

The soap retaining means includes at least one upwardly turned rung. The ends of each rung extend generally upwardly from below the lower front edge of the chute to substantially its upper edge and project from the inclined bottom wall of the chute; the upper surfaces of the ends generally lie in a plane which is parallel to the inclined bottom wall so that the bar of soap is supported out of contact with it. The lower portion of each rung has a curved section which is turned upwardly so that its tip is higher than the lower front edge of the chute; thus the bar of soap is supported above the lowest points on the rung where moisture tends to accumulate.

As an alternative, the soap retaining means comprises the chute having a pair of holes in proximity to its upper edge and a single support having a pair of rungs and a hook formed at each end of the support, the hooks being inserted into the holes so that the support, when attached to the chute, rests partially on its inclined bottom wall.

The soap bar receptacle has a base which may be rigidly attached to the ledge of a sink basin or to the wall of a shower stall by adhesives or by mechanical means. As an alternate embodiment, there is provided a bar soap receptacle with an enlarged base, a portion of which is disposed behind the vertical plane which passes through the rear upper edge of the chute. The bottom wall of the enlarged base provides a greater surface area with which to attach the soap receptacle to the ledge of a sink basin.

There is also disclosed a chute having projections which extend generally downwardly from beneath its inclined bottom wall and which are each slidably mounted on a wall of the base, so that the chute can be removed from the bar soap receptacle without disturbing its base.

BRIEF DESCRIPTION OF THE DRAWINGS

Further details are explained below with the help of the examples illustrated in the attached drawings in which:

FIG. 1 is a perspective view of one embodiment of the present invention positioned on the ledge of a sink basin;

FIG. 2 is an enlarged side elevational view of the embodiment shown in FIG. 1;

FIG. 3 is an enlarged frontal elevational view of the embodiment shown in FIG. 1;

FIG. 4 is an enlarged bottom plan view of the embodiment shown in FIG. 1;

FIG. 5 is a frontal elevational view of a further embodiment of the present invention;

FIG. 6 is a cross-section VI—VI from FIG. 5;

FIG. 7 is a perspective view of a further embodiment of the present invention;

FIG. 8 is a cross-section VIII—VIII from FIG. 7 on an enlarged scale;

FIG. 9 is an exploded view of the embodiment shown in FIG. 7 on an enlarged scale;

FIG. 10 is an enlarged bottom plan view of the embodiment shown in FIG. 7;

FIG. 11 is a perspective view of a still further embodiment of the present invention; and FIG. 12 is an enlarged side elevational view of the embodiment shown in FIG. 11.

Like reference characters indicate corresponding parts throughout the several views of the drawings.

DESCRIPTION OF THE PREFERRED EMBODIMENT

Referring to FIGS. 1 through 3 of the drawings, a bar soap receptacle 10 according to the present invention is shown affixed to the ledge 9 of a sink basin, not shown. In the receptacle 10, there is provided a chute 11 having an inclined wall 14 and retainer walls 12 and 13 which extend upwardly at approximately right angles thereto. A base 16 and a soap retaining means such as a pair of rungs 15 is connected to the inclined wall 14 as described hereinbelow. A portion of the chute 11 and the rungs 15 extend over the edge **9*a* of the ledge 9** and downwardly into the sink basin.

Each of the rungs 15 is supported by its ends **15*a*, 15*b* which are disposed parallel to one another (FIG. 3) and turned upwardly at an acute angle to the plane of the curved portion 15*c* of the rung (FIG. 2). The inclined wall 14 and the upwardly turned ends 15*a*, 15*b*, which run from below the lower front edge 11*a* to substantially the upper edge 11*b* of the chute 11, comprise a drain surface for a bar of soap 8 deposited in the receptacle 10 as shown in FIG. 2. As illustrated in FIG. 3, the upwardly turned ends are spaced from the retainer walls 12 and 13 and from each other to allow relatively free flow of liquid down the chute 11. The upper surfaces of the ends 15*a*, 15*b* define a plane which is generally parallel to the inclined wall 14 for supporting the bar of soap 8 out of contact therewith; the distance separating this plane and the proximate surface of the inclined wall 14** is preferably at least ⅛ inch to facilitate the rapid drainage of soap solutions and the air drying of the underside of the soap bar.

Most of the water and suds transferred with a bar of soap to the receptacle 10 runs rapidly downwardly along the ends 15*a*, 15*b* to the lowest points 15*d*, 15*e* on the rungs 15. From these points, the water and suds fall to the sink basin. Residual amounts of soap solution which would otherwise tend to accumulate as film near the lower front edge 11*a* of the chute 11 and form a soap scum upon evaporation also migrate downwardly along the lower portions of the rungs 15 and concentrate as droplets near the points 15*d* and 15*e*. These droplets tend to fall to the sink basin rather than evaporate in place.

Each of the rungs, including its supporting ends, has a generally circular cross-section so that a rounded surface engages and retains the bar of soap 8 as illustrated in FIG. 2. Thus minimal contact areas are provided between the soap retaining means and the bar of soap. Moreover, the areas of the curved portion 15*c* of each rung in contact with the lower surface of the soap bar are minimized by having each rung bent so that its tip 15*f* is higher than the rest of the curved portion 15*c*, as is best seen in FIG. 2. By elevating the tip 15*f* thusly the lower surface of the bar of soap 8 is held above the sections of the rungs near the lowest points 15*d*, 15*e* where moisture accumulates.

In FIGS. 1 through 4, the base 16 is formed integral with the chute 11. The base 16 comprises a lower base section 17, a support wall 18, and side walls 19*a* and 19*b*. The support wall 18 extends generally vertically downward from the upper edge 11*b* of the chute 11 and forms a right angle with the lower base section 17. Each side wall 19*a*, 19*b* is triangular in shape and extends at generally right angles to the support wall 18. The ratio of the height of the support wall 18 to the width of the lower base section 17 determines the slope of the inclined wall 14 which is preferably in the range 5:4 to 2:1. The acute angle between the inclined wall 14 and a horizontal plane is correspondingly in the range 51° to 63°. These steep slopes for the inclined wall 14 insure fast drainage of water and suds away from a bar of soap placed in the chute 11.

As seen in FIGS. 2 and 4, the leading edge 17*a* of the lower base section 17 abuts the lower surface 14*a* of the inclined wall 14 above the lower front edge 11*a* in such a way that it is disposed entirely below the leading edge 17*a*. The lower edges of the side walls 19*a* and 19*b* are substantially even with the bottom surface 17*b* of the lower base section 17. A portion of the chute 11 thus extends generally downwardly below the lower base section 17. When the lower base section 17 is affixed to the ledge 9, the downwardly protruding portion of the chute 11 directs water and suds away from the ledge 9 and into the sink basin. Moreover, the proximity of the chute 11 to the sink basin allows a user to transfer a bar of soap directly from the water to the bar soap receptacle 10 without dripping water or suds on the ledge 9.

The bar soap receptacle 10 is formed of a suitable material having a slick, non-stick surface, such as polyethylene or stainless steel. Preferably, the material is also impervious to soap acid and to other chemicals in cleansing compounds. In FIGS. 1 through 4, the chute 11 and the base 16 comprise a single, unitary piece which may be formed from a sheet of a suitable plastic or metal. The rungs 15 are pre-formed from a wire or rod and may be sheathed or coated with a plastic material in a manner well-known to those engaged in the plastic industry. The ends 15*a* and 15*b* are rigidly attached to the chute 11 by any appropriate means such as gluing in those cases in which the rungs 15 are sheathed or pre-coated with plastic. The ends 15*a* and 15*b* may also be welded or soldered to a metal chute; and the soap bar receptacle 10 may thereafter be coated with a plastic material or left uncoated. Alternately, the chute 11, the base 16, and the rungs 15 in the soap bar receptacle 10 may comprise a single, unitary piece molded of clay or of plastic by the use of suitable molds in a manner well-known to those engaged in the plastic and molding industry.

In use, two pieces of an adhesive material 63 are glued to the bottom surface 17*b* of the base 16 as shown in FIG. 4. The adhesive material 63 may be a Rubber Maid bath tub peel or similar product commonly affixed to the lower surface of a bath tub to provide a rough surface to prevent a bather from slipping on the otherwise smooth tub surface. The exposed face 63*a* of the adhesive material is sticky and is usually covered with an outer layer of paper, not shown, which must be peeled away before affixing the soap bar receptacle to the ledge 9. Alternately, the lower base section 17 may be affixed to the ledge 9 by mechanical means such as suction cups or mechanical fasteners.

The soap bar receptacle 10 in FIGS. 1 through 4 may also be mounted on a shower stall or other wall by gluing the adhesive material 63 to the back surface of the support wall 18 and then pressing the soap bar receptacle against the wall until it adheres. The soap bar receptacle may also be wall-mounted by appropriate mechanical means such as those described thereinbefore for a ledge-mounted base.

FIGS. 5 and 6 illustrate a preferred embodiment of the soap bar receptacle 20 in which the pair of rungs 15 has been replaced with a single support 25. The support 25 may be a metal wire or rod bent to form the rungs 25*a* and 25*b*. The support 25 is of generally circular cross-section to minimize the points of contact with the bar of soap and is preferably of the order of ⅛ to 3/16 inch of thickness. The support 25 may be made of stainless steel or of a like material which is smooth and preferably impervious to soap acid and to cleansing compounds. Alternately, the support 25 may be a metal wire or rod coated with a plastic material. As is seen most clearly in FIG. 6, the ends of the support 25 terminate to form hooks 25*c*. The hooks 25*c* are attached to the chute 21 by means of a pair of holes 24*a* and 24*b* formed in the inclined wall 24. The holes 24*a* and 24*b* are disposed near the upper edge of the chute 21 and are spaced from the retainer walls 22 and 23. When the hooks 25*c* are inserted into the holes 24*a* and 24*b*, the support 25 rests in part upon the inclined wall 24 and in part is suspended below the lower front edge 21*a* of the chute 21.

As in the previous unit, the chute 21 and the base 26 in the soap bar receptacle 20 shown in FIGS. 5 and 6 comprise a single, unitary piece which may be formed from a sheet of plastic or of metal. Alternately, this piece may be molded of vitreous clay or of plastic. Tub caulking compound may be used to seal the openings between the hooks 25*c* and the holes 24*a*, 24*b* to prevent the entry of soap solution therethrough.

FIGS. 7 through 10 show an alternative embodiment of the invention in which the chute and the soap retaining means are similar to those described in FIGS. 1 through 4 with the exception that the chute 31 is detachable from the base 36 so that the chute can be removed for rinsing under a water faucet without disturbing the base. A further modification is that the soap bar receptacle 30 includes a backsplash 40 which extends generally vertically upward from the upper edge 31*b* of the chute 31. The backsplash 40 both reinforces a back projection 41 which is connected thereto and provides an additional barrier to the spillage of water and suds on the ledge 9. The upper portion of the back projection 41 is contiguous with the backsplash 40; the lower portion of the back projection 41 which extends downwardly of the upper edge 31*b* is disposed at an acute angle to the inclined wall 34. An inclined projection 42, which is best seen in FIGS. 8 and 9, is disposed beneath and parallel to the inclined wall 34. The upper portion of the inclined projection 42 is thicker than the lower portion thereof; the lower portion is separated from the lower surface 34*a* of the inclined wall 34 by a short distance to form a slot 43. The back projection 41, the chute 31, and the inclined projection 42 may comprise a single, unitary piece; or the projections 41 and 42 may be rigidly attached to the backsplash 40 and to the inclined wall 34, as shown in FIGS. 7 through 9, by gluing or other appropriate means.

The base 36 of the soap bar receptacle 30 shown in FIGS. 7 through 10 comprises a lower base section 37, a support wall 38, triangularly-shaped side walls 39*a* and 39*b*, and a sloping forward wall 44. The acute angle which is formed between the forward wall 44 and the lower base section 37 is approximately equal to 90° less the acute angle that is formed between the inclined wall 34 and the back projection 41. The distance separating the lower portion of the inclined projection 42 and the lower surface 34*a* of the inclined wall 34 is approximately equal to the thickness of the sloping forward wall 44. The chute 31 is attached to the base 36 by first hooking the lower portion of the inclined projection 42 behind the upper edge 44*a* of the sloping forward wall 44 so that it can enter the slot 43 and then sliding the chute 31 downwardly until the upper portion of the support wall 38 abuts against the lower portion of the back projection 41.

A still further embodiment of the present invention is shown in FIGS. 11 and 12. The soap receptacle 50 is similar to the one described in FIGS. 1 through 4 with three exceptions. First, the chute 51 is modified to include a backsplash 60 extending generally vertically from the upper edge 51*b* of the inclined wall 54. The backsplash 60, inclined wall 54, and retainer side walls 52 and 53 comprise a single, unitary piece. The soap bar receptacle 50 is further modified to have an enlarged lower base section 57 which is partially disposed behind the vertical plane which passes through the upper edge 51*b* of the chute 51. The enlarged lower base section 57 provides a greater surface area with which to affix the soap receptacle to the ledge 9 of a sink basin. Moreover, the support wall 58 is modified so that is is inclined at an acute angle to the lower base section 57, thus allowing the slope of the inclined wall 54 to remain substantially the same as that described hereinabove for the inclined wall 14. An upper section 61 extends generally vertically from the upper edge 58*a* of the support wall 58 and is contiguous and parallel to the backsplash 60. The upper section 61 and the backsplash 60 may comprise a single, unitary piece; or they may be glued together as illustrated in FIG. 12 or otherwise rigidly attached to each other.

Thus, in accordance with the present invention, there is provided a soap bar receptacle having a steeply sloped chute to which is connected a pair of rungs for holding a bar of soap so that no surface thereof is disposed in a generally horizontal position. The lower front edge of the chute and the lower portions of the rungs are disposed below the edge of a ledge to which the base of the receptacle is rigidly attached to direct water and suds away from the soap bar and downwardly into the sink basin. An alternate embodiment provides a chute which is detachable from the base so that the chute may be removed and rinsed under a water faucet without moving the base.

Although several embodiments of the invention have been illustrated in the accompanying drawings and described in the foregoing detailed description, it will be understood that the invention is not limited to the embodiments disclosed, but is capable of numerous rearrangements, modifications, and substitutions without departing from the scope of the invention.

What is claimed is:

1. A receptacle for a bar of soap which comprises:

(a) a chute having at least one inclined wall which is also a bottom wall thereof and two side walls which extend generally upwardly from the inclined bottom wall, the chute having an opening between the ends of the side walls, the opening extending approximately the entire length of the lower front edge of the inclined bottom wall, the lower front edge of the inclined bottom wall being adapted to extend over the edge of a ledge and downwardly into a sink basin; and (b) a soap retaining means having at least two ribs connected to the chute, the upper portions of the ribs extending upwardly from the inclined bottom wall to hold the bar of soap out of contact therewith, the lowermost portions of the ribs extending over the lower front edge to facilitate drainage of water and suds away from the bar of soap and to concentrate residual soap solution below the chute so that it will drip into the basin before evaporating to form a soap scum.

2. A receptacle for a bar of soap according to claim in which each rib includes a bent portion which extends generally upwardly from the lowermost point of the rib, the bent portion being spaced from the lower front edge of the inclined bottom wall to facilitate the concentration of residual soap solution on a downwardly sloping projection so that the soap solution will form droplets that fall to the sink basin rather than evaporate in place.

3. A receptacle for a bar of soap which comprises:

(a) a chute having at least one inclined wall which is also a bottom wall thereof, the lower front edge of the inclined bottom wall being adapted to extend over the edge of a ledge and downwardly into a sink basin; and (b) at least one rung connected to the chute, the ends of the rung extending across the upper side of the inclined bottom wall, the lowermost portions of the rung extending over the lower front edge, each surface of the rung which is adapted to engage the bar of soap having a downward slope which is generally in the longitudinal direction of the portion of the rung in which the surface is disposed, thereby providing continuous pathways along which water and suds can flow rapidly downhill away from the bar of soap and along which residual soap solution can migrate, concentrating below the chute so that the solution will drip into the basin before evaporating to form a soap scum.

4. A receptacle for a bar of soap according to claim 3 in which the lower portion of the rung has a curved section including a tip, each surface of the curved section below the tip having an ever increasing downward slope to speed the the flow of water and suds to the lowermost points of the rung, the plane of the upper surface of the curved section forming an acute angle with the inclined bottom wall of the chute, so that only a small area of the curved section contacts the bar of soap and supports it above the lowest points of the rung where moisture tends to accumulate.

5. A receptacle for a bar of soap according to claim 3 in which the chute is rigidly attached to a base which is adapted to be affixed to the ledge of a sink basin.

6. A receptacle for a bar of soap according to claim 5 in which the base further comprises a support wall which extends at an approximately right angle from the horizontal plane, so that the base may be positioned contiguous to a vertical wall located behind the chute.

7. A receptacle for a bar of soap according to claim 5 in which the base is enlarged, being substantially disposed behind the vertical plane which passes through the rear upper edge of the chute, thus providing a greater surface area with which to affix the soap bar receptacle to the ledge of a sink basin.

8. A receptacle for a bar of soap which comprises:

(a) a chute having at least one inclined wall which is also a bottom wall thereof, the lower front edge of the inclined bottom wall being adapted to extend over the edge of a ledge and downwardly into a sink basin;

(b) a base upon which the chute is slidably mounted, so that the chute can be removed from the bar soap receptacle without disturbing its base; and (c) a soap retaining means connected to the chute and adapted to hold a bar of soap in a generally vertical position, the soap retaining means being partially disposed downwardly of the lower front edge to facilitate drainage of water and suds away from the bar of soap and to concentrate residual soap solution below the chute so that it will drip into the basin before evaporating to form a soap scum.

9. A receptacle for a bar of soap according to claim 8 in which the soap retaining means further comprises a pair of rungs, the ends of the rungs extending approximately parallel to each other and generally upwardly from below the lower front edge of the inclined bottom wall to substantially the upper edge thereof.

10. A receptacle for a bar of soap according to claim 8 in which the soap retaining means further comprises a pair of rungs, the rungs comprising a single, unitary piece.

11. A receptacle for a bar of soap which comprises:

(a) a chute having at least one inclined wall which is also a bottom wall thereof, the lower front edge of the inclined bottom wall being adapted to extend over the edge of a ledge and downwardly into a sink basin;

(b) a soap retaining means connected to the chute; and (c) a base upon which the chute is detachably mounted, the chute having means projecting from the underside thereof for engaging the base, so that the chute can be removed from the bar soap receptacle without disturbing its base.

* * * * *